United States Patent [19]

Gariboldi

[11] Patent Number: 4,899,098

[45] Date of Patent: Feb. 6, 1990

[54] LOW VOLTAGE DROP SERIES REGULATOR WITH OVERVOLTAGE AND OVERCURRENT PROTECTION

[75] Inventor: Roberto Gariboldi, Lacchiarella, Italy

[73] Assignee: SGS-Thomson Microelectronics S.p.A., Agrate Brinza, Italy

[21] Appl. No.: 211,925

[22] Filed: Jun. 27, 1988

[30] Foreign Application Priority Data

Jun. 25, 1987 [IT] Italy ..... 21039 A/87

[51] Int. Cl.[4] ..... G05F 1/569

[52] U.S. Cl. ..... 323/277; 323/276; 361/18; 361/91; 361/93

[58] Field of Search ..... 323/276, 277; 361/18, 361/79, 86, 87, 91, 93

[56] References Cited

U.S. PATENT DOCUMENTS

| | | | |
|---|---|---|---|
| 4,371,824 | 2/1983 | Gritter | 361/18 |
| 4,703,390 | 10/1987 | Fay et al. | 323/277 |
| 4,723,191 | 2/1988 | Menniti | 361/91 |
| 4,750,079 | 6/1988 | Fay et al. | 323/277 |

OTHER PUBLICATIONS

"Power Integrated Circuits: Problems, Tradeoffs, and Solutions", IEEE Journal of Solid-State Circuits, vol. SC-13, No. 3, Jun. 1978.

*Primary Examiner*—Patrick R. Salce
*Assistant Examiner*—J. L. Sterrett
*Attorney, Agent, or Firm*—Wenderoth, Lind & Ponack

[57] ABSTRACT

A series voltage regulator includes a protective circuit that detects the collector current from a PBP power transistor and the collector-emitter voltage thereof. Such current and voltage signals are generated, respectively, by an auxiliary PNP transistor having a collector current which is proportional to that of the PNP power transistor, and by a circuit connected between the emitter and the collector of the PNP power transistor. The collector current and collector emitter voltage signals are processed by a circuit which, whenever the current and voltage values are greater than preset maximum values, reduces the PNP power transistor current and maintains it within permissible limits. The protective circuit does not affect the minimum voltage drop between the input and output of the regulator and may be dimensioned so as to use the maximum extent of the S.O.A. of the PNP power transistor.

6 Claims, 2 Drawing Sheets

LOW VOLTAGE DROP SERIES REGULATOR WITH OVERVOLTAGE AND OVERCURRENT PROTECTION

BACKGROUND OF THE INVENTION

The present invention relates to electronic voltage regulators and, more particularly, to an integratable electronic series regulator which has a minimum input-output voltage drop and has PNP bipolar power output pass transistor.

A voltage regulator is inserted between a generator and a load with the object of obtaining a continuous voltage across the load which has a preset value and which is substantially independent—within preset limits—from the current passing through the load.

In this type of regulator, it may be necessary to protect the pass transistor, through which flows the current which passes through the load, so as to enable the transistor to operate within the safe operating area (S.O.A.).

A number of devices are known for the protection of NPN power transistors which ensure operation in the S.O.A. under different overload conditions.

For example, reference is made to the solutions set out in paragraph IV—"Short circuit and overvoltage protection" of the article "Power Integrated Circuits: Problems, Tradeoffs and Solutions" published in the "IEEE Journal of Solid State Circuits," Vol. SC13, No. 3, June 1978 and, more particularly, to the protective device shown in FIG. 8 of the article and illustrated in FIG. 1 of the drawings accompanying the present application, in which the voltage and current of the power transistor are monitored continuously and simultaneously. In order to obtain a voltage drop which is proportional to the current flowing through the load, this solution uses a resistance element (a gold wire RW) in series with the power transistor.

This solution, although normally also applicable to PNP transistors, has the disadvantage that the series resistance produces a voltage drop that cannot be tolerated in applications whose purpose is to minimize the input-output voltage drop of the regulator. Therefore, the prior art is inadequate in cases where it is necessary to ensure protection within the S.O.A. for the PNP power transistor and at the same time have a minimum series voltage drop thereacross.

SUMMARY OF THE INVENTION

One object of the preset invention is to provide a series regulator in which the voltage drop is solely caused by a PNP power output pass transistor.

Another object of the invention is to provide the power transistor with a protective device for operating within the S.O.A.

Still another object of the invention is to provide a protective device which permits the use of the maximum extent of the S.O.A. of the power output pass transistor.

These objects are achieved, according to the preset invention by an integratable series voltage regulator having a low voltage drop, and having a power transistor protected against overvoltages and overcurrents, comprising: an input terminal and an output terminal respectively connected to an emitter terminal and to a collector terminal of said power transistor; a common terminal which is common to both said input and output terminals; a first means for providing a voltage proportional to an output voltage between said output terminal and common terminal; a comparison and control circuit means having an output connected to a base terminal of said power transistor, a first input terminal connected to said first means and a second input terminal connected to a reference voltage, said reference voltage having a value such that a control current flows into said base of said power transistor in order to keep said output voltage between said output terminal and common terminal at a substantially constant predetermined value; a means for determining a collector current of said power transistor, comprising an auxiliary transistor having its base and emitter terminals respectively coupled to said base and emitter terminals of said power transistor, wherein said collector of said auxiliary transistor provides a first measuring current which is substantially proportional to said collector current of said power transistor; a circuit means for determining the collector-emitter voltage of said power transistor and for generating a second measuring current at its output terminal when said collector-emitter voltage of said power transistor exceeds a preset value; a processing circuit means having a summing input node, to which are connected said collector of said auxiliary transistor and said output terminal of said circuit means for determining the collector-emitter voltage of said power transistor, and an output terminal connected to a third input terminal of said comparison and control circuit means, said processing circuit means reducing a control current to said power transistor as a function of the algebraic sum of said first and second measuring currents, when said sum exceeds a limiting value of current, said limiting value being arranged such that said collector current and said collector-emitter voltage of said power transistor define a point within the safe operating area (S.O.A.) of said power transistor.

BRIEF DESCRIPTION OF THE DRAWINGS

The present invention will be better understood by reference to the ensuing detailed description of two practical embodiments given solely by way of illustrative, non-limiting example in the accompanying drawings, in which.

DESCRIPTION OF THE PREFERRED EMBODIMENTS

Figure 1:
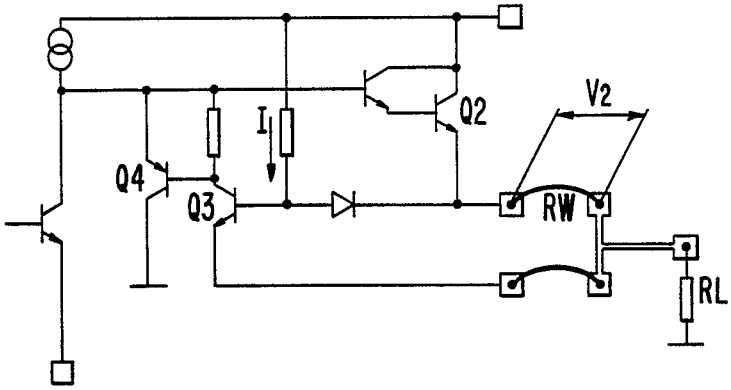
FIG. 1 is a circuit diagram of a protective circuit made in accordance with the prior art.

FIG. 1 shows a prior art protective circuit for an NPN transistor.

Now, referring to FIG. 1, the current from the collector of transistor Q3 is determined by the current I which is proportional to the collector-emitter voltage of power transistor Q2, and by the voltage V2, which is proportional to the current flowing through the transistor Q2. Whenever the current I increases so as to activate transistor Q4, the current from the base of the power transistor diminishes in order to limit the current flowing through the power transistor.

Figure 2A:
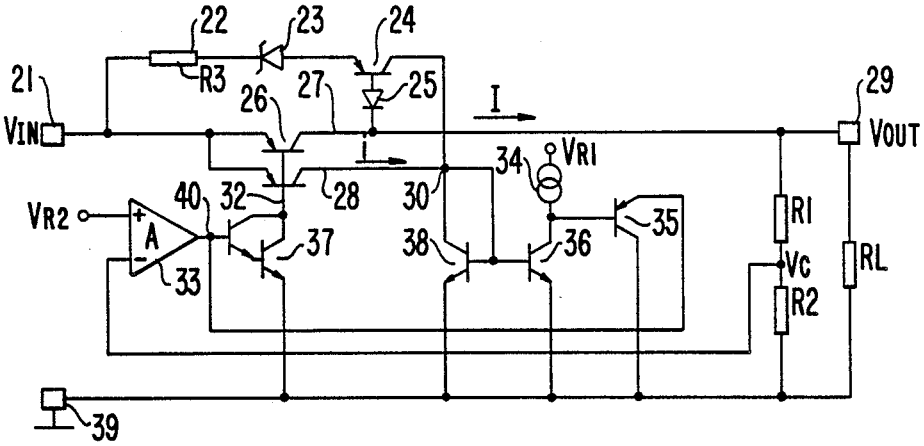
FIG. 2*a* is a simplified circuit diagram of a first practical embodiment of the present invention.

FIG. 2*a* is a simplified electrical diagram of the electronic voltage regulator which develops a minimum voltage drop and is provided with a simplified form of the protective circuit for operating within the S.O.A.

The regulator comprises a PNP power transistor 26, which has its emitter and collector respectively connected to the input terminal 21 and output terminal 29. A resistance divider consisting of resistance elements R1 and R2 is inserted between the output terminal 29 and a ground terminal 39 which is common to both the input and output terminals. A comparison and control circuit is inserted between the divider R1 and R2 and the base of the PNP power transistor 26. The comparison control circuit comprises an operational amplifier 33, which has its non-inverting input connected to a reference voltage source VR2 and has its inverting input connected to the output of the divider R1 and R2; and a pair 37 of NPN transistors interconnected in a Darlington configuration, the base of the input transistor thereof being connected to the output of amplifier 33, the collectors of the two NPN transistors being connected to the base of transistor 26, and the emitter of output transistor of the two NPN transistors being connected to ground. A load RL is inserted between output terminal 29 and ground.

During operation, the output voltage Vr of divider R1 and R2, which is proportional to the output voltage VOUT, is compared with reference voltage VR2. If the voltage Vr differs from voltage VR2, the amplifier 33 acts on Darlington pair 37 and thereby on the base current of transistor 26 so as to keep the voltage between output terminal 29 and the terminal 39 constant by varying the current I flowing through load RL. An auxiliary PNP transistor 28 has its base and emitter respectively connected to the base and the emitter of the power transistor 26 and has a collector current which is proportional to the current I which flows through the power transistor 26 in accordance with a constant k defined by the following equation:

$$i = I/k$$

where k is substantially determined by the ratio of the emitter areas of transistor 26 and auxiliary transistor 28.

A voltage VIN is applied between input terminal 21 and terminal 39 and this voltage determines the voltage at output terminal 29, to which the load RL is connected. In order to detect the voltage VCE between the collector and emitter of the PNP power transistor, a circuit is provided which comprises the series circuit consisting of diode 25, the base-emitter junction of PNP transistor 24, a Zener diode 23, and a resistor 22. The collector of transistor 24 is connected at a circuit node 30 to the collector and the base of an NPN transistor 38 connected in the manner of a current mirror to an NPN transistor 36. The collector of transistor 36 is connected through a current generator 34 to a reference voltage source VR1 and to the base of PNP transistor 35 whose collector and emitter are respectively connected to ground and to the base of the input transistor of the Darlington pair 37.

Now, with reference to FIG. 2*a*, in order to satisfy the relationship:

$$VIN - VOUT < VZ + 2VBE,$$

(where VZ is the Zener voltage of the diode 23, and VBE is the diode voltage across diode 25 and the base-emitter voltage of transistor 24), there flows into node 30 only the current i, while transistor 24 is not activated. Since the series branch made up of resistor 22, Zener diode 23, transistor 24 and diode 25 has the voltage difference VIN-VOUT across it, which is equal to the voltage difference VCE between the collector and emitter of the power transistor 26, the preceding inequality can be rewritten as follows:

$$VCE < VZ + 2VBE$$

Upon establishment of the condition:

$$i \geqq Is$$

where Is defines a preset current threshold determined by the current generator 34 and by the reference voltage VR1, transistor 35 is activated, thereby diminishing the collector current from the pair of Darlington connected transistors 37. This limits the current flowing through the PNP power transistor 26 to a value ICC in accordance with the relationship:

$$ICC = Is \times k.$$

Upon establishment of the condition:

$$VCE \geqq VZ + 2VBE$$

transistor 24 is activated and the corresponding current from the collector flows into node 30, thereby establishing the relationship:

$$IC/k + (VCE - VZ - 2VBE)/R3 = Is,$$

where R3 is the resistance of resistor 22.

The preceding relationship can be rewritten as follows:

$$IC = -k/R3 \times VCE + k \times Is + k(VZ + 2VBE)/R3$$

which expresses a linear relationship between the current IC flowing through the collector of the PNP power transistor 26 and the corresponding voltage VCE.

Figure 2B:
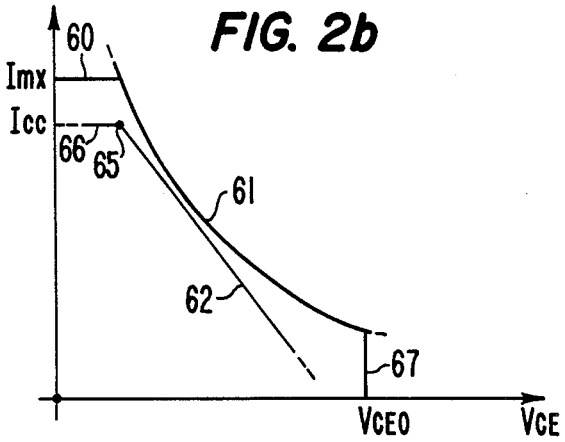
FIG. 2*b* is a diagram of the permissible S.O.A. for the power transistor of a regulator in accordance with the practical embodiment depicted in FIG. 2*a;*

The advantages of the protective device will be understood more readily from a consideration of the simplified diagram shown in FIG. 2*b* of the S.O.A. of transistor 24—determined by its components 60 and 61 and 67, characterizing, respectively, the maximum current Imx permitted by the physical characteristics of power transistor 26, such as the metallizations and the characteristics of the ohmic connection contact with the semiconductor chip, the "secondary direct breakdown" curve and the line corresponding to voltage VCEO.

The diagram in FIG. 2*b* shows the lines 66 and 62 representing, respectively, the maximum current, ICC and the previously determined linear relationships IC=f (VCE), which delimit the permissible S.O.A. for the PNP power transistor 26 within the corresponding S.O.A.; in said figure, the point 65 and the coordinates (VZ+2VBE, k Is) is also plotted.

Figure 3A:
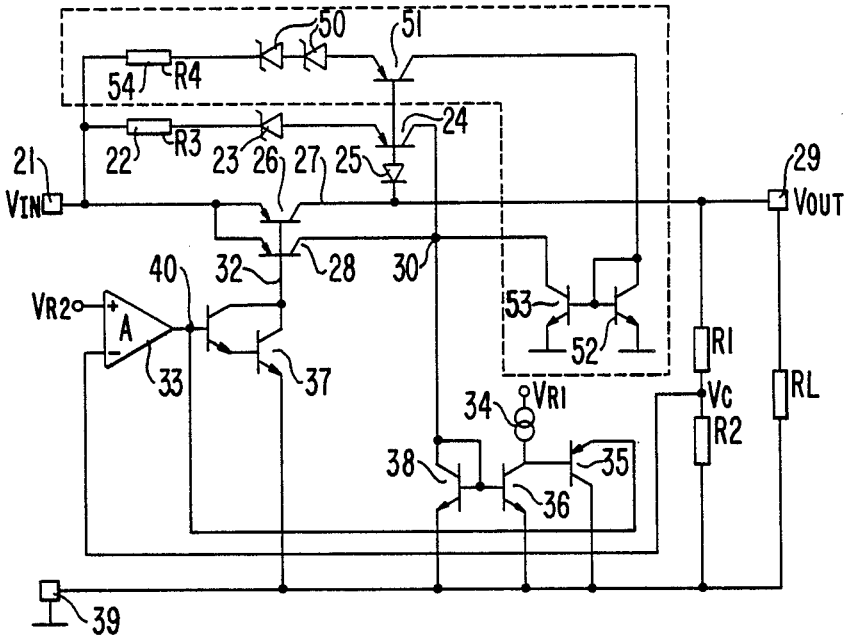
FIG. 3*a* is a simplified circuit diagram of a second practical embodiment of the present invention, comprising a preferred embodiment of the protective device of the power transistor.

The simplified circuit diagram of a second embodiment of the invention, comprising a preferred embodiment of the protective device of power transistor 26 is shown in FIG. 3*a*. This digram merely differs from that shown in FIG. 2*a* by an auxiliary circuit element enclosed by a dashed line in the figure, and comprises a second branch that determines the voltage VCE of the PNP power transistor and has, connected in series, the base-emitter junction of a PNP transistor 51, two Zener diodes 50 and a resistor 54. PNP transistor 51 has its base connected to the base of the PNP transistor 24 and has its collector connected to the collector and the base of an NPN transistor 52 connected in a mirror current fashion to another NPN transistor 53, whose collector is connected to the circuit node 30.

Figure 3B:
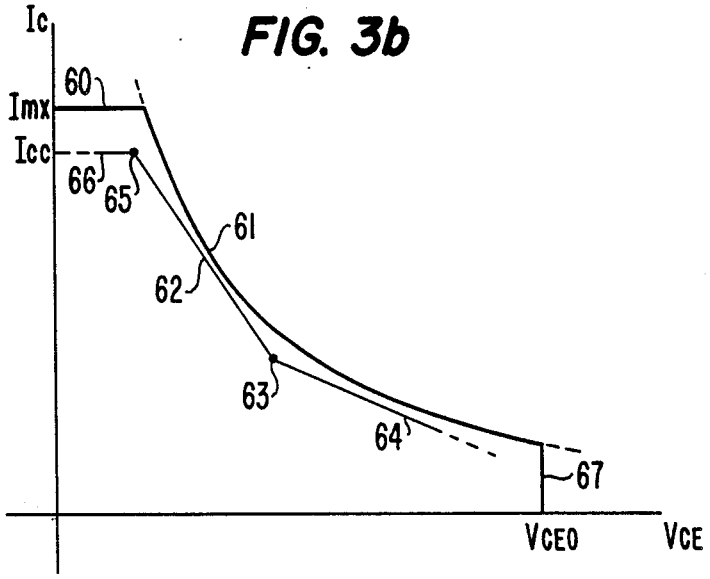
FIG. 3*b* is a diagram of the permissible S.O.A. for a power transistor of a regulator according to the practical embodiment of the present invention shown in FIG. 3*a*.

The auxiliary circuit allows a higher degree of approximation of the curve delimiting the S.O.A. of the PNP power transistor. In fact, with reference to FIGS. 3*a* and 3*b* and using arguments similar to those used in the description of the circuit of FIG. 2*a*, there are plotted $$VCE \geqq 2VZ + 2VBE$$

for the point 63 and the line 64 which better approximates the line delimiting the S.O.A. of the power transistor. The point 63 and the line 64 respectively have the coordinates and slopes expressed by the following relationships:

$$(2VZ+2VBE,\ k\times Is-k\times VZ/R3),\ -k\times(R4-R3)/R4\ R3.$$

It is pointed out that, through suitable selection of the dynamic value of resistor R4, it is possible to obtain a better approximation of the curve 61 of the S.O.A. in such a way as to use the maximum extent allowed for said area.

It will be evident that modifications and variations can be made to the preferred embodiment of the invention without departing from the scope of the invention. For example, it is possible to add one or more circuit branches comprising a resistor, a plurality of Zener diodes, and a PNP transistor in order to better approximate, by means of further broken-line branches, the line delimiting the S.O.A. of the power transistor.

I claim:

1. An integratable series voltage regulator having a low voltage drop, and having a power transistor protected against overvoltages and overcurrents, comprising:

an input terminal and an output terminal respectively connected to an emitter terminal and to a collector terminal of said power transistor;

a common terminal which is common to both said input and output terminals; a first means for providing a voltage proportional to an output voltage between said output terminal and common terminal;

a comparison and control circuit means having an output connected to a base terminal of said power transistor, a first input terminal connected to said first means and a second input terminal connected to a reference voltage, said reference voltage having a value such that a control current flows into said base of said power transistor in order to keep said output voltage between said output terminal and said common terminal at a substantially constant predetermined value;

a means for determining a collector current of said power transistor, comprising an auxiliary transistor having its base and emitter terminals respectively coupled to the base and emitter terminals of said power transistor, wherein a collector of said auxiliary transistor provides a first measuring current which is substantially proportional to said collector current of said power transistor;

a circuit means for determining the collector-emitter voltage of said power transistor and for generating a second measuring current at its output terminal when said collector-emitter voltage of said power transistor exceeds a preset value;

a processing circuit means having a summing input node, to which are connected said collector of said auxiliary transistor and said output terminal of said circuit means for determining the collector-emitter voltage of said power transistor, and an output terminal connected to a third input terminal of said comparison and control circuit means, said processing circuit means reducing a control current to said power transistor as a function of the algebraic sum of said first and second measuring currents, when said sum exceeds a limiting value of current, said limiting value being arranged such that said collector current and said collector-emitter voltage of said power transistor define a point within safe operating area of said power transistor.

2. A regulator as set forth in claim 1, wherein said circuit means for determining the collector-emitter voltage of said power transistor comprises at least one circuit branch, which is connected between said emitter and collector of said power transistor and comprises the series connection of: a resistance element, at least one Zener diode and an emitter-base junction of a determining transistor whose collector is coupled to said output terminal of said circuit means for detecting the collector-emitter voltage of said power transistor.

3. A regulator as set forth in claim 2, wherein said circuit means for determining the collector-emitter voltage of said power transistor comprises a first circuit branch whose determining transistor has its collector connected directly to said output terminal of said means for determining the collector-emitter voltage of said power transistor and a second circuit branch having a determining transistor which has its collector coupled to said input summing node via a current mirror circuit.

4. A regulator as set forth in claim 3, wherein said processing circuit means further comprises a circuit means for setting said limiting current value, a current mirror having a first branch connected to said input summing node, and a second branch connected to said circuit means for setting said limiting current value and to a base of a coupling transistor whose emitter is connected to an output terminal of said processing circuit means.

5. A regulator as set forth in claim 2, wherein said processing circuit means further comprises a circuit means for setting said limiting current value, a current mirror having a first branch connected to said input summing node, and a second branch connected to said circuit means for setting said limiting current value and to a base of a coupling transistor whose emitter is connected to an output terminal of said processing circuit means.

6. A regulator as set forth in claim 1, wherein said processing circuit means further comprises a circuit means for setting said limiting current value, a current mirror having a first branch connected to said input summing node, and a second branch connected to said circuit means for setting said limiting current value and to a base of a coupling transistor whose emitter is connected to an output terminal of said processing circuit means.

* * * * *

UNITED STATES PATENT AND TRADEMARK OFFICE

CERTIFICATE OF CORRECTION

PATENT NO. : 4,899,098
DATED : February 6, 1990
INVENTOR(S) : Roberto Gariboldi

It is certified that error appears in the above-identified patent and that said Letters Patent is hereby corrected as shown below:

On the title page, column 3, line 55, following the words 'consisting of', insert the word 'a'.

column 6, line 37, following the words 'terminal of said', insert the word 'circuit'.

Signed and Sealed this

Eleventh Day of May, 1999

*Attest:*

Q. TODD DICKINSON

*Attesting Officer*

*Acting Commissioner of Patents and Trademarks*